US007697709B2

(12) United States Patent
Mei et al.

(10) Patent No.: US 7,697,709 B2
(45) Date of Patent: Apr. 13, 2010

(54) SOUND DIRECTION/STEREO 3D ADJUSTABLE EARPHONE

(75) Inventors: David Mei, Forest Hills, NY (US); Jin-Xia Bao, Forest Hills, NY (US); Si Ping Bao, Forest Hills, NY (US)

(73) Assignee: Cyber Group USA, Inc., Forest Hills, NY (US)

( * ) Notice: Subject to any disclaimer, the term of this patent is extended or adjusted under 35 U.S.C. 154(b) by 876 days.

(21) Appl. No.: 11/523,347

(22) Filed: Sep. 19, 2006

(65) Prior Publication Data

US 2008/0080733 A1 Apr. 3, 2008

Related U.S. Application Data

(60) Provisional application No. 60/777,833, filed on Mar. 1, 2006, provisional application No. 60/720,585, filed on Sep. 26, 2005.

(51) Int. Cl.
*H04R 25/00* (2006.01)

(52) U.S. Cl. ..... 381/379; 381/370; 381/374

(58) Field of Classification Search ..... 381/370, 381/374, 379

See application file for complete search history.

(56) References Cited

U.S. PATENT DOCUMENTS 3,751,608 A * 8/1973 Weingartner ..... 381/372
4,453,050 A * 6/1984 Enokido ..... 381/381
4,783,822 A 11/1988 Toole et al.
6,097,827 A 8/2000 Yang
6,369,952 B1 4/2002 Rallison et al.
6,427,018 B1 7/2002 Keliiliki
6,434,250 B1 8/2002 Tsuhako
6,772,853 B2 * 8/2004 Yang ..... 181/129
7,006,649 B2 * 2/2006 Natvig ..... 381/371
7,356,156 B2 * 4/2008 Ruegg ..... 381/379
2004/0213428 A1 * 10/2004 Lenhard-Backhaus ..... 381/370

* cited by examiner

*Primary Examiner*—Curtis Kuntz
*Assistant Examiner*—Matthew Eason
(74) *Attorney, Agent, or Firm*—Collard & Roe, P.C.

(57) ABSTRACT

A sound direction/stereo effect 3D adjustable earphone in one aspect contains an adjustable headband clip to hold the left and right earphone parts. An adjustable holder is at the left and right ends of the earphone and at the topside of an ear cup. The ear cup contains a 3D adjustable ear speaker at the center of the earphone for delivery of sounds from the earphone to a user. A 3D direction adjustable unit works with the ear speaker. The adjustable unit contains a connector such as a little ball at one end to fit in a corresponding connector such as a hole at the holder and another connector such as a little ball to fit into another corresponding connector such as a hole at the speaker. In this way, the ear speaker can be freely pushed out/pulled in and pulled/pushed/rotated adjustably in X-Y-Z or three dimensions.

20 Claims, 15 Drawing Sheets

SOUND DIRECTION/STEREO 3D ADJUSTABLE EARPHONE

CROSS REFERENCE TO RELATED APPLICATIONS

This application claims priority under 35 U.S.C. §119(e)(i) and the benefit of copending U.S. Provisional Application Ser. Nos. 60/720,585, entitled "Method and Apparatus of Sound Direction/Stereo Adjustable Earphone," filed Sep. 26, 2005, and 60/777,833, entitled "Method and Apparatus of Sound Direction/Stereo Effect 3D Adjustable Earphone," filed Mar. 1, 2006, which are incorporated by referenced herein.

BACKGROUND OF THE INVENTION

1. Field of the Invention

The present invention relates to an earphone for use with audio systems and communication systems and more particularly to an adjustable earphone for achieving stereo sound direction and effect with adjustment in three dimensions.

2. The Prior Art

There are many types of adjustable earphones already on the market. Nevertheless, two problems remain unsolved. The first problem results when a user of an earphone uses the earphone for too long a period of time. Such extended use creates in the user an uncomfortable feeling or possibly damages the user's hearing because the sound is directed continuously at and hits one point of the user's ear nerve, which causes exhaustion in the ear nerve. The second problem results when a user uses an earphone with a center speaker that does not fit his or her ear shape or ear tunnel. Again, such earphones creates in the user an uncomfortable feeling or possibly causes harm to the user's hearing.

U.S. Pat. No. 4,783,822 to Toole et al. discloses a multi-adjustable headband including earcups or earphone elements having speaker elements. When the headband is adjusted up or down, the earcup containing the ear speakers will be moved up and down also (in X axis direction, i.e. in one direction only). Adjustment or rotation of the ear speakers in three dimensions (3D) for the comfort of a user's hearing is neither disclosed nor contemplated.

U.S. Pat. No. 6,097,827 to Yang discloses an adjustable earphone with a microphone and a hook for mounting the earphone on a user's ear. The speaker of the earphone is mounted in a speaker chamber that connects to the hook by an outrigger. The user can slide the outrigger connected to the speaker chamber upwardly or downwardly in a tunnel of a housing along the tunnel. The user can also rotate the outrigger in the tunnel of the housing. Therefore, the speaker chamber can be moved up and down in one direction along an X axis and rotated 360 degrees along the X axis (Y axis level) or in X-Y two dimensions. This device, however, does not and cannot achieve adjustment of the speaker chamber for the user's hearing comfort in a third Z dimension or adjustment in three (3D) dimensions because of the way the tunnel is fixed.

U.S. Pat. No. 6,427,018 to Keliiliki discloses an adjustable earphone for personal audio and communication systems. The ear mounted earphone includes a speaker housing for positioning a speaker at the entrance to the auditory canal of an ear of a user. An elongate boom extends from the speaker housing so that the boom may be moved longitudinally and rotationally for adjustment purposes. As a result of that adjustment, the speaker can be moved up and down along the boom in one X axis direction and be rotated 360 degrees along the boom in Y axis level. This device, however, does not and cannot achieve the adjustment of the speaker for the user's hearing comfort in a third Z dimension or adjustment in three (3D) dimensions because of the way the boom is fixed.

U.S. Pat. No. 6,434,250 to Tsuhako discloses a stereo headset with angled speakers. The speaker units may be positioned at optimum angles of incidence and distances relative to the ears of a listener. Adjustable positioning means are provided to enable control over the horizontal spatial dimension of the stereo sound. The patent provides for the positioning of the speaker unit at a distance from the ears of a listener, and at an angle (best angle at 27 degrees) relative to an imagined vertical plane bisecting the head of a listener into symmetrical halves. The speakers have no sound conceal function and have only a one dimensional angle adjustment. Accordingly, this device does not and cannot achieve the adjustment of the speaker for the user's hearing comfort in a third Z dimension or adjustment in three (3D) dimensions because the adjustment angle is in only one dimension and the speaker is open for noise.

U.S. Pat. No. 6,369,952 to Rallison et al. discloses a head-mounted personal visual display apparatus with an image generator and a holder. With this device, when a user wishes to adjust the position of the earphone, the user rotates an earphone arm about an axis to adjust the vertical distance and slides the arm along an axis slot to adjust the horizontal or lateral location of the earphone. It is apparent that the device does not and cannot achieve the adjustment of the speaker for the user's hearing comfort in a third Z dimension or adjustment in three (3D) dimensions because the adjustment axis arm operates in one dimension only.

Bluetooth wireless earphones have been successfully received in the market for years. The bluetooth earphone is combined in an earphone unit with an ear clip. The earphone speaker of a bluetooth earphone is obviously not adjustable in three (3D) dimensions. Moreover, discomfort is experienced when the ear clip is too heavy or hangs too long on the bottom of the user's ear.

Another problem is that all old and current earphones are preset for sound direction and channel stereo effects and usually focus on the back head center of the earphone user. When an earphone user moves his head up or down, or turns his head left or right, the sound stereo effect from the earphone is always the same, which is not real time sound.

Generally speaking, with known earphones there is no way to adjust the earphone speaker in a 3D stereo sound direction and effect if a user feels uncomfortable. A user can move only the whole ear cup up/down or back/forth in one direction with no Z depth adjustment.

Therefore, in order to solve the foregoing problems and drawbacks, a need exists for an easily adjustable earphone that avoids sound hitting directly and continuously on one point of a user's ear nerve and that provides the most flexible adjustment of stereo sound direction and effect in three dimensions to minimize hearing damage and loss to an earphone user and maximize the stereo sound instantaneous real time effect experienced by the earphone user.

SUMMARY OF THE INVENTION

The present invention provides an adjustable earphone, with a speaker element positioned to cover the ear or to be disposed within the ear canal or tunnel of the listener. In one aspect, the earphone includes an adjustable earphone clip unit, an adjustable holder unit connected to the clip unit, and an ear cup unit connected to the holder unit that includes an adjustable filter unit for blocking and directing sound.

An adjustable center speaker unit is disposed in the ear cup unit. The adjustable earphone also includes an adjustable unit including a flexible band having a first end and a second end, a first connecting member such as a ball disposed at the first end, and a second connecting member such as a ball disposed at the second end. The first connector or ball is within a holder connecting member such as a socket of the holder unit and the second connector or ball is received within a speaker connecting member such a socket in the speaker unit. The position and function of the balls and sockets can be switched with each other if necessary.

The adjustable earphone clip unit may be a headband clip unit adapted to be worn on a user's head or an ear clip unit adapted to be supported by a user's ear. The ear cup unit may include a shell for mounting the adjustable holder unit and the adjustable center speaker unit. Within a recess of the shell may be disposed an adjustable and movable clip female mark, and a male clip mark may be disposed on an edge of the center speaker unit. The male and female marks cooperate to permit adjustment of the center speaker unit within the shell in any direction in three dimensional space. Indicia may be circumferentially disposed on a surface of the center speaker unit to facilitate adjustment of the center speaker unit within the shell by a user.

In another aspect, the adjustable earphone includes an ear plug unit, an adjustable center speaker unit disposed in the ear plug unit, and an adjustable unit. The ear plug unit includes an adjustable filter unit for blocking and directing sound and is dimensioned to fit between outer and middle tunnels of a user's ear. The adjustable unit includes a flexible band having a first end, a second end, a first connector disposed at the first end, and a second connector disposed at the second end. The first connector connects with a speaker connector of the speaker unit, such as a speaker receptacle, for example by being received within the speaker receptacle of the speaker unit, and the second connector connects with a filter connector of the filter unit, such as a filter receptacle, for example by being received within the filter receptacle of the filter unit. A wire connects the earplug unit to a sound source.

In another aspect, the adjustable earphone includes an adjustable earphone clip unit, an adjustable holder unit connected to the clip unit, an ear cup unit connected to the holder unit, an adjustable center speaker unit disposed in the ear cup unit, and an adjustable unit. The adjustable unit includes a flexible band having a first end and a second end, a first connector such as a ball disposed at the first end and connecting with, such as by being received within, a holder connector, such as a socket, of the holder unit, and a second connector such as a ball disposed at the second end and connecting with, such as by being received within, a speaker connector such as a socket of the speaker unit. The ear cup unit includes first, second and third sound check members disposed within the ear cup unit. The first sound check member is larger than the second and third sound check members. The sound check members are adapted to create sound flows that create a sound resonant area within the ear cup unit wherein adjustment of the center speaker unit in any direction in three dimensional space generates a changeable resonance among the sound check members.

In another aspect, the adjustable earphone includes an adjustable holder unit, an ear cup unit connected to the holder unit including an adjustable filter unit for blocking and directing sound, an adjustable holder unit and an adjustable center speaker unit disposed in the ear cup unit, an adjustable unit, and an ear band unit adapted to be supported by a user's ear. The adjustable unit includes a flexible band having a first end and a second end, a first connector and a second connector. The first connector may be a first ball disposed at the first end and connecting with, such as by being received within, a holder connector such as a socket of the holder unit. The second connector may be a second ball disposed at the second end and connecting with, such as by being received within, a speaker connector such as a socket of the speaker unit. The ear band unit includes an ear front top piece and an ear back piece. The ear front top piece is adapted to follow an upper portion of a user's ear. The ear back piece is adapted to follow a rear portion of a user's ear and be supported on the rear portion of the ear.

In another aspect, the adjustable earphone includes an ear band unit including an ear front top piece, an ear front bottom piece, and an ear back piece. The earphone also includes an ear cup unit including an adjustable filter unit for blocking and directing sound and a shell for mounting an adjustable holder unit and an adjustable center speaker unit.

The adjustable holder unit is connected to the ear band unit and the ear cup unit and includes a first connector such as a spherical connector at a first holder unit end connecting with, such as by being received within, an ear band connector such as a receptacle of the ear band unit and a second spherical connector such as a spherical connector at a second holder end connecting with, such as by being received within, a shell connector such as a receptacle of the shell.

The adjustable unit includes a flexible band having a first end and a second end, a first connector such as a ball disposed at the first end and connecting with, such as by being received within, an ear band connector such as a socket of the ear band unit and a second connector such as a ball disposed at the second end and connecting with, such as by being received within, a speaker connector such as a socket of the speaker unit.

The adjustable earphone may further include an adjustable joint disposed on the front bottom piece of the ear band unit, which connects the ear front bottom piece with the ear back piece to facilitate adjustment of the ear cup unit around a user's ear shape As discussed below, the present invention in one aspect provides a sound direction/stereo effect 3D adjustable earphone including an adjustable earphone headband clip, an adjustable holder unit, an ear cup housing, an adjustable center speaker unit, and an adjustable unit containing a bendable/holdable band and two balls at each end. One small ball of the adjustable unit fits into the hole of the holder unit, and another, preferably larger, ball fits into the center hole of the center speaker unit. The position and function of the balls and holes can be switched with each other if necessary. The ear cup unit also contains a sound conceal and sound direction adjustable filter unit. An adjustable sound resonant area is created inside the arrangement. Using an ear band holding arrangement, the ear center speaker unit and/or the entire earphone can be independently or suspendedly moved out or around adjustably and conveniently to achieve stereo sound direction and effect adjustable function and effectively to avoid any kind of uncomfortable earphone-ear contact pressure on part or all of a user's ear or inside the user's ear tunnel. The earphone contains a continuous computerized sound wave/level/channel/band/frequency controller to create a real time stereo sound in real time and a realistic surrounding effect when the earphone user moves his or her head.

In short, the present invention provides a system that achieves high flexibility and stereo sound direction 3D adjustability with a real time stereo sound and a realistic surrounding effect that follows a user's head movement.

An object of the present invention is to provide an earphone with a center speaker or speakers providing adjustable sound in three (3D) dimensions.

Another aspect of the present invention is to avoid injury to ear auditory nerves by providing a freely-adjustable earphone center speaker in any direction at any time and for any situation for the rest and comfort of the ear nerves of a user.

Yet another object of the present invention is to provide an earphone with a center speaker or speakers that is easily and conveniently adjustable in three (3D) dimension by a user at any time and in any situation without requiring movement of the entire earphone or the entire ear cups.

Another object of the present invention is to provide an earphone with a center speaker or speakers adjustable in three (3D) dimensions to create additional stereo sound effects.

Yet another object of the present invention is to provide an earphone with center speaker stereo sound three (3D) dimensional adjustability for the comfort of a user and his or her auditory feeling.

Another object of the present invention is to provide an earphone with a center speaker or speakers stereo sound three (3D) dimensional adjustability to create instant real time 3D stereo sound effects following a user's head movements.

Yet another object of the present invention is to provide an earphone with a computerized stereo sound wave and level and frequency controller unit for better real time sound stereo output.

Another object of the present invention is to provide an earphone that provides a changeable resonance or rebound function into a user's ear tunnel for comfortable sound listening.

Yet another object of the present invention is to provide a new earphone ear band holding method combined with the adjustable 3D earphone speaker for stereo sound output directions and levels for more comfortable wearing and listening.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
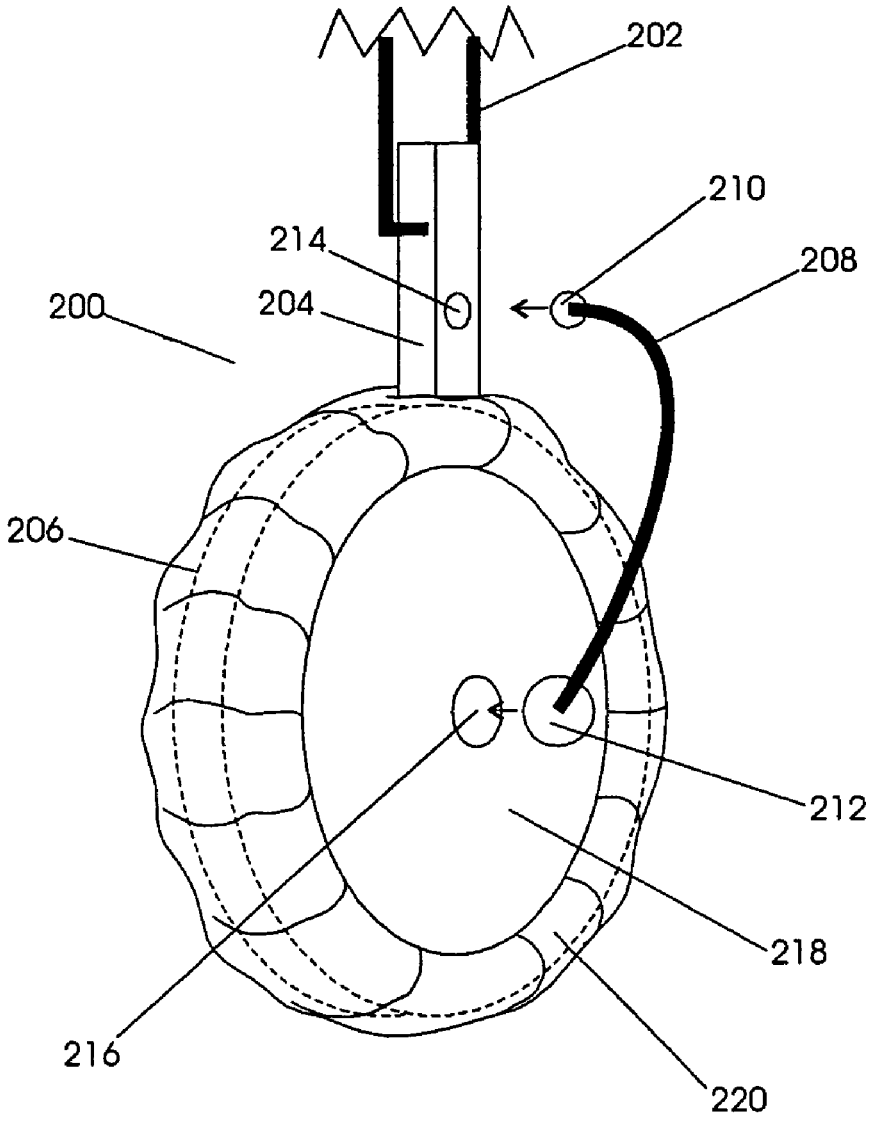
FIG. 1 is a perspective view of one earphone in accordance with a first embodiment of the invention.
Figure 2:
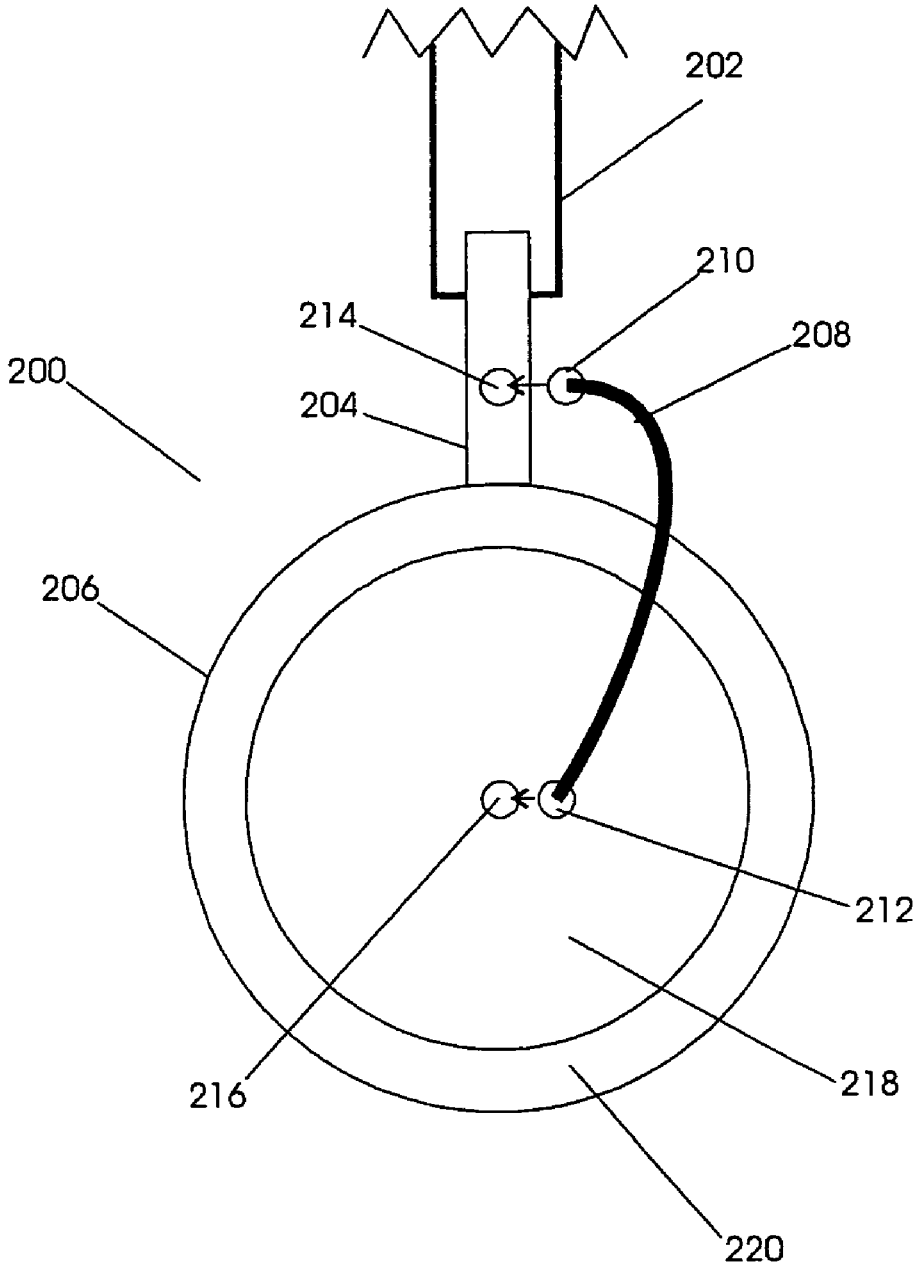
FIG. 2 is a front view of the embodiment of FIG. 1.

Turning now in detail to the drawings, FIGS. 1-2 show a portion of an adjustable earphone 200 which may be the left or the right portion of the earphone or headset for providing adjustable sound direction/stereo effect in three (3D) dimensions. Preferably, earphone 200 is comfortably worn on the user's head via a headband or other connector for the left and right portions that rests on or arches around the user's head. As is well-known, the earphone may be associated with an electrical input signal for driving a speaker element of the earphone, such as speaker unit 218.

Adjustable earphone 200 includes an adjustable headband clip unit 202 for up or down movement and to hold the left and right parts of earphone 200. An adjustable holder unit 204 is connected to headband clip unit 202 at the left and right ends of earphone 200. Each holder unit 204 is connected at a topside of an ear cup unit 206. Ear cup unit 206 contains an independently adjustable ear speaker unit 218 at the center of the portion of earphone 200 for delivery of sounds from earphone 200 to a user's ear hearing system. Ear cup unit 206 also contains a sound conceal and sound direction adjustable filter unit 220.

Adjustable earphone 200 also includes a direction adjustable unit 208 working with adjustable ear speaker unit 218. Adjustable unit 208 contains two small spheres or balls 210, 212 at respective ends of adjustable unit 208. First ball 210 is adapted to fit in a hole or socket 214 of holder 204. Second ball 212 is adapted to fit in another hole or socket 216 of adjustable ear speaker unit 218. The position and function of the balls and sockets can be switched with each other if necessary. In this way, ear center speaker unit 218 can be freely pulled out or pushed in and turned around adjustably in X-Y-Z directions, i.e. three dimensionally, in order to achieve an adjustable stereo sound direction and effect function for comfortable delivery of stereo sound into a user's ear without moving the whole earphone 200 or ear cup unit 206.

It should be understood that balls 210, 212 may be replaced with other types of male or female connectors. For example, adjustable unit 208 may have sockets in place of the balls for mating with balls instead of sockets on holder 204 and ear speaker unit 218. For simplicity of discussion, the embodiment shown in FIGS. 1-2 has been and will be described where the adjustable unit connectors are balls and the holder and speaker unit connectors are sockets.

In addition, earphone 200 may contain well-known devices and features (not shown) such a micro central processing unit/multichip package (CPU/MCP) unit and a mini memory unit, a light emitting diode (LED) or liquid crystal display (LCD) unit, a computerized level controller unit, an attachable universal serial bus (USB) stick or disc unit, a mini speaker unit, a switch unit and voice volume controller, a wireless or cable unit, a circuit board unit, a battery unit, a microphone unit, an integrated micro sound amplifier unit, a sound purifier unit, an internal or external antenna unit, a wireless unit, and an internet protocol (IP) based communicator unit. The attachable USB stick or disc unit may contain a micro CPU/MCP unit and memory unit. The switch unit and voice volume controller unit may be in key style, wheel style, or touch panel style, or digital LED/LCD screen selection style. The micro CPU/MCP unit (digital signal processor) provides full range digital audio. The wireless unit delivers to or receives from a circumaural wireless stereo radio frequency (RF) system, or internet server system.

The CPU/MCP unit contains a digital signal processor providing full range digital audio output of earphone 200.

Therefore, sound direction/stereo effect 3D adjustable earphone 200 may be used wirelessly or through a cable in a regular earphone system, regular headset/headphone system, radio system, telephone system, personal computer (PC) system, notebook computer, internet communication system, cellular/satellite communication system, home theater system, car/ship/airplane audio system, game, or ear hearing assistance equipment, etc.

The 3D adjustable direction unit 208 adjusts the sound stereo delivery direction and effect of center speaker unit 218 into a user's ear so that the sound impact of center speaker unit 218 does not always hit at one point of a user's ear drum directly and continuously. A strong direct and continuous sound impact constantly on one point of a user's eardrum or on one point of the ear tunnel causes discomfort and harm to the user, sometimes hearing loss, harm to the shape of the ear, and illness to the ear tunnel. In accordance with the invention, a user can adjust center speaker unit 218 to let strong sound impact smoothly pass toward and through the natural shape of the outer and middle ear tunnel adjustably, so that the sound impact is not constantly directed continuously on one point of the eardrum or one point of the outer and middle ear tunnel.

Direction adjustable unit 208 and adjustable center speaker unit 218 both work together to create a 3D stereo sound effect in the ear outer space and middle tunnel and ear auditory tube without having to move the whole earphone 200 or ear cup unit 206.

When adjustable ear center speaker unit 218 delivers stereo sounds into a user's ear, the user can adjust the angle, level, or position of central speaker unit 218 in any one or all of X-axis, Y-axis, or Z-axis directions, i.e. in three (3D) dimensions, to achieve a stereo sound impact direction in his or her ear outer space and ear hole and ear middle tunnel and ear auditory tube for more perfect harmony and less or no harm from unnecessary resonance directly hit on his or her eardrum. In this way, 3D adjustable center speaker unit 218 minimizes harmonic and intermodulation distortion, gets an excellent dynamic stereo response, ensures optimum sensitivity, controls the sound pressure and contact pressure and internal surround reflection, and generates an extended special sound effect. Adjustable center speaker unit 218 may contain multiple sound levels/channels/bands that are adjustable in three dimension for better stereo effects.

Adjustable unit 208 may be made of any spiral or bendable material, for example a cord or tube having a metal spiral core or a plastic spiral core. The material should be flexible, adjustable, and able to hold firmly at any time and in any situation. First ball 210 located at one end of adjustable unit 208 plugs into hole or socket 214 located on adjustable holder unit 204. Second ball 212 located at the other end of adjustable unit 208 plugs into hole or socket 216 located preferably at the center of center speaker 218 as indicated by the arrow. Balls 210, 212 can be rotated and are held firmly inside sockets 214, 216. The position and function of the balls and sockets can be switched with each other if necessary.

The size, design, shape, location, and material of balls 210, 212 and sockets 214, 216 may vary as well as the specific cooperating method. Balls 210, 212 may be provided with teeth and sockets 214, 216 may be provided with markings or indentations to facilitate adjusting and holding of the balls in the sockets.

The computerized sound wave/level/frequency controller unit 280 (detailed in FIGS. 14-15) in center speaker unit 218 detects and analyzes the direction change of speaker 218 and then automatically adjusts the sound direction/stereo output effects of speaker 218. Once a user changes the direction and position of speaker 218, e.g. during driving, walking, running, sitting, standing, or playing sports, the computerized sound wave/level/frequency controller unit 280 attached outside or inside speaker 218 detects and analyzes that change through a digitalized X-Y or 3D magnetic sensor system or other suitable position change detection system. After detection and analysis, the computerized sound wave/level/frequency controller unit 280 processes the analysis of the position-changed speaker sound stereo direction/output effect and sends commands based on the analyzed results to control and change the sound multiple channels, waves, levels, frequencies, balances, bases, volumes and sound hit directions of speaker 218 into a user's ear field for better sound direction/stereo output effects as detailed in FIGS. 14-15.

The computerized sound wave/level/frequency controller unit 280 can be used in a standard earphone system, a standard headset/headphone system, a radio system, a telephone system, a PC system, a notebook computer, an internet communication system, a cellular/satellite communication system, a home theater system, a car/ship/airplane audio/video system, a game system, a multiple player, or in hearing assistance equipment, etc.

Figure 14:
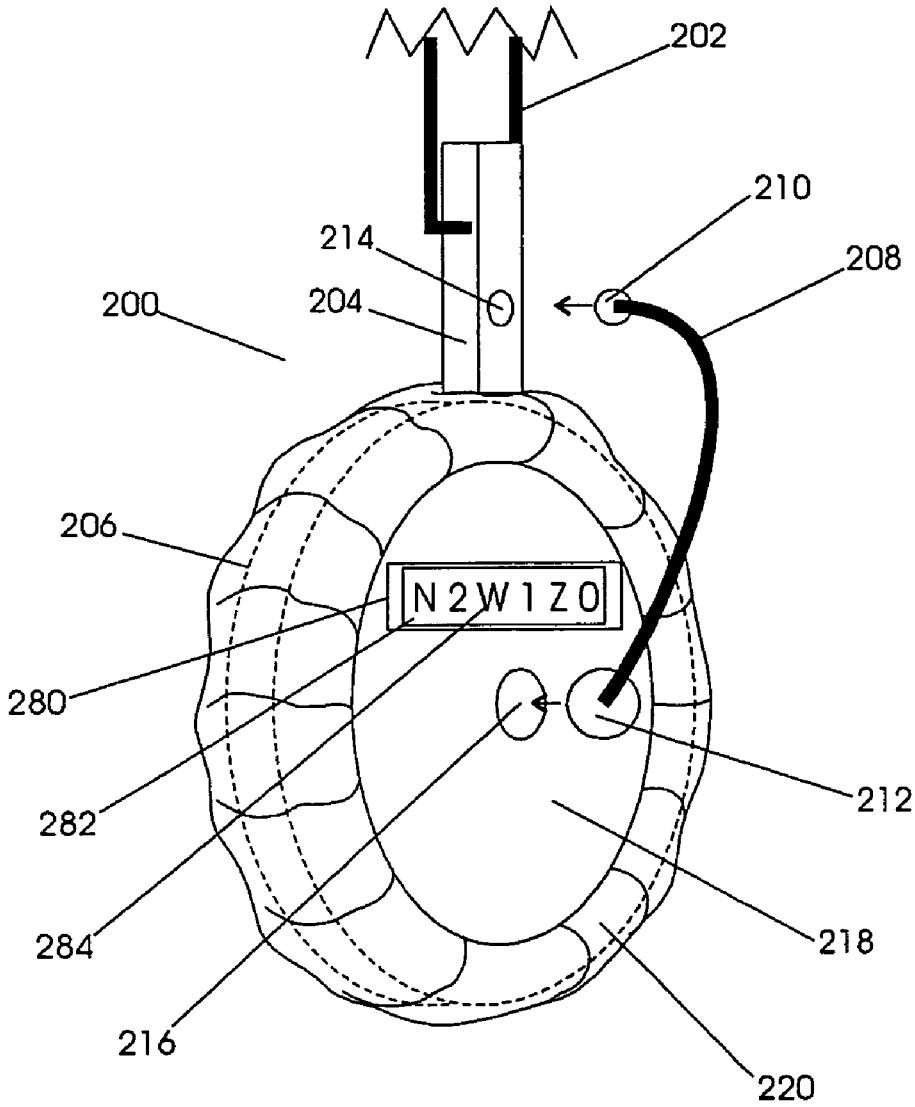
FIGS. 14-15 shows further details of a sound stereo wave/level frequency controller unit in association with the embodiment of FIG. 2.
Figure 15:
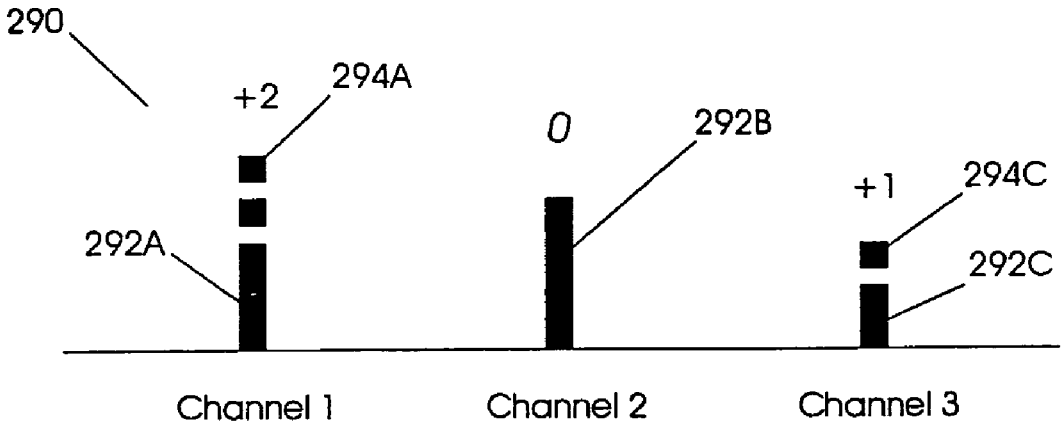

The computerized sound wave/level/frequency controller unit 280 can also detect and analyze the direction and position change of one or both side ear cups of earphone 200 following a user's head movement and then automatically adjust the sound direction/stereo effects of speaker 218 for actual sound stereo effects as detailed in FIGS. 14-15.

When a user using earphone 200 stays in one direction for a certain time (e.g. twenty seconds), the computerized sound wave/level/frequency controller unit 280 of earphone 200 adjusts the sound direction and sound frequency back to reference coordinates X-0', Y-0', and Z-0'.

If the user changes the direction of his or her earphone 200, the computerized sound wave/level/frequency controller unit 280 will detect that change in X-Y-Z or 3D directions and will digitize those changes to new values such as X-1', Y-2', Z-3' to add on to the original sound direction and sound frequency playing in earphone 200.

Therefore, there is a mode selection function, such as for use in driving, walking, running, in movie theaters, in sporting events, or for random audio selection, etc. for the sound stereo wave/level/frequency controller unit 280.

The sound stereo wave/level/frequency controller unit 280 can also independently and/or coordinately control and balance the sound stereo effects between the left and right ear cups or speakers of earphone 200 to create more theater-like or realistic stereo sounds. The earphones may be provided with a switch to allow the user to select whether the controller unit 280 will create theater-like or realistic stereo sounds or other situational stereo sounds.

The size, design, shape, method of operation, location and material of the computerized sound wave/level/frequency controller unit 280 may vary. The unit 280 may be provided with a set up or selection program to permit the user to select the controller unit 280 for earphone 200 only or for center speaker 218 only or for both earphone 200 and center speaker 218 to work together at the same time and in the same situation or at different times and different situations, pre-set or otherwise.

The computerized sound wave/level/frequency controller unit 280 may include a digital stereo direction/frequency self-adjustment system (not shown).

Stretchable, sound conceal and noise filter unit 220 may be made of any suitable soft stretchable material, for example, fabric, leather or soft plastic. Many layers may be applied onto unit 220 for sound concealing and noise filtering. Unite 220 may contain many small holes (not shown) for air breathing and noise filtering purposes. Unit 220 maximizes blocking out of noise, minimizes ambient sounds, and creates a better stereo field between closed ear cup unit 206 and a user's ear.

Unit 220 has sufficient elasticity to accommodate the 3D movement and 3D rotation of center speaker 218.

Unit 220 and ear cup unit 206 are preferably covered with soft material to create a soft and warm touch when in contact with a wearer's ears as a closed ear cup. Ear cup unit 206 and unit 220 are preferably provided with high quality materials for excellent wearing comfort.

Unit 220 and ear cup unit 206 may be designed in an earphone style designed to cover the entire ear, in a partial ear-covering earphone style, or in an ear tunnel covered ear snug style.

A high speech clarity and voice recognition can be achieved by adjusting the sound stereo angle of adjustable speaker unit 218 and sound stereo cover and filter unit 220 for reducing sound reflection and mix in a user's ear.

The 3D adjustable ear speaker system 208, 218 shown in FIGS. 1-2 can also be used in any headset, headphone, or ear-snug set.

The method of operation, size, design, shape, location, material and style of adjustable ear speaker system containing adjustable unit 208 and ear speaker unit 218 may vary.

Earphone 200 or ear cup unit 206 may contain multiple speakers or center speaker units 218.

A loose or stretchable layer (not shown) may be added or installed between the outside edge of center speaker 218 and the inside edge of ear cup 206 to provide more room for adjustability and greater sound filtering.

Figure 3:
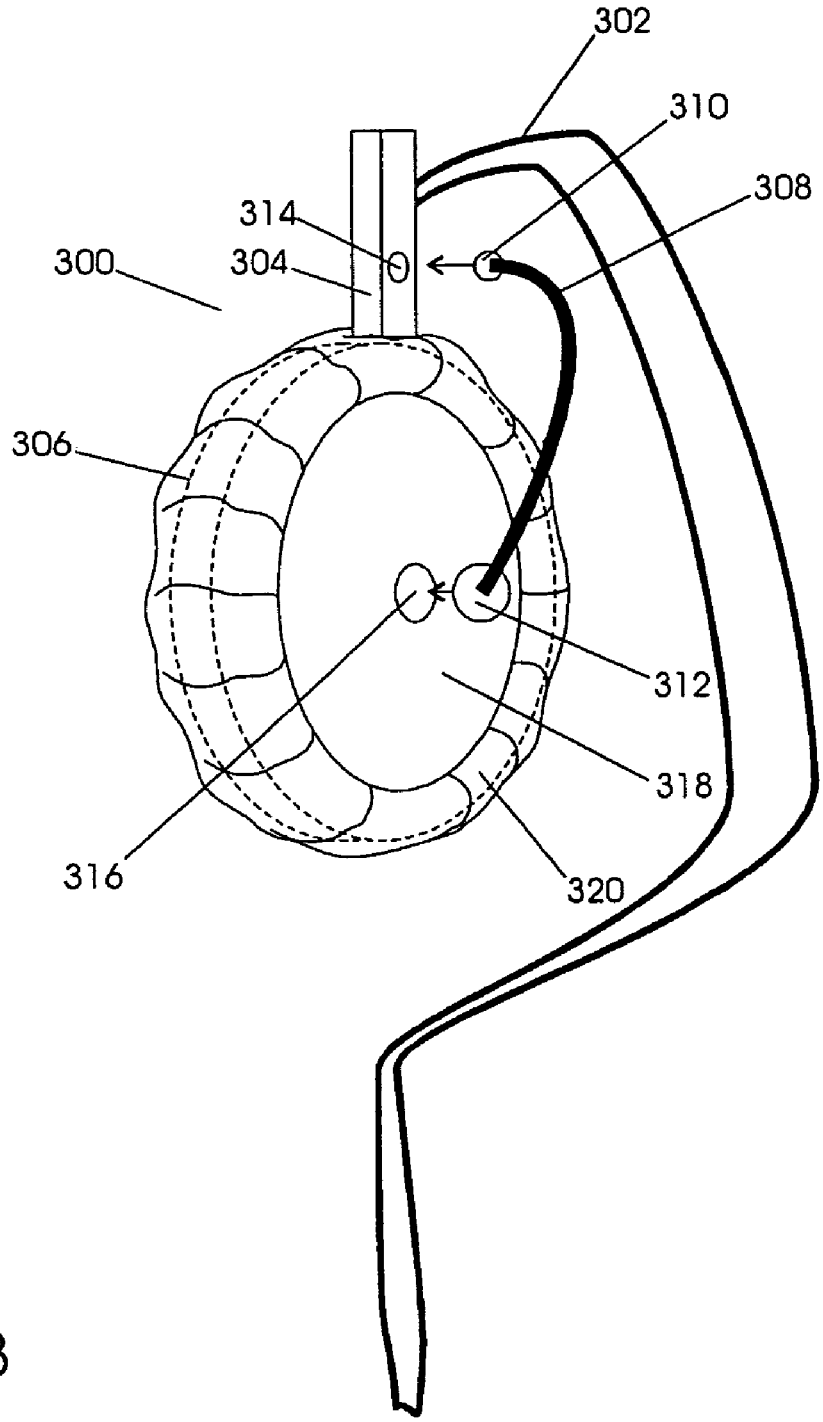
FIG. 3 is a perspective view of a second embodiment of one earphone in accordance with the invention.
Figure 4:
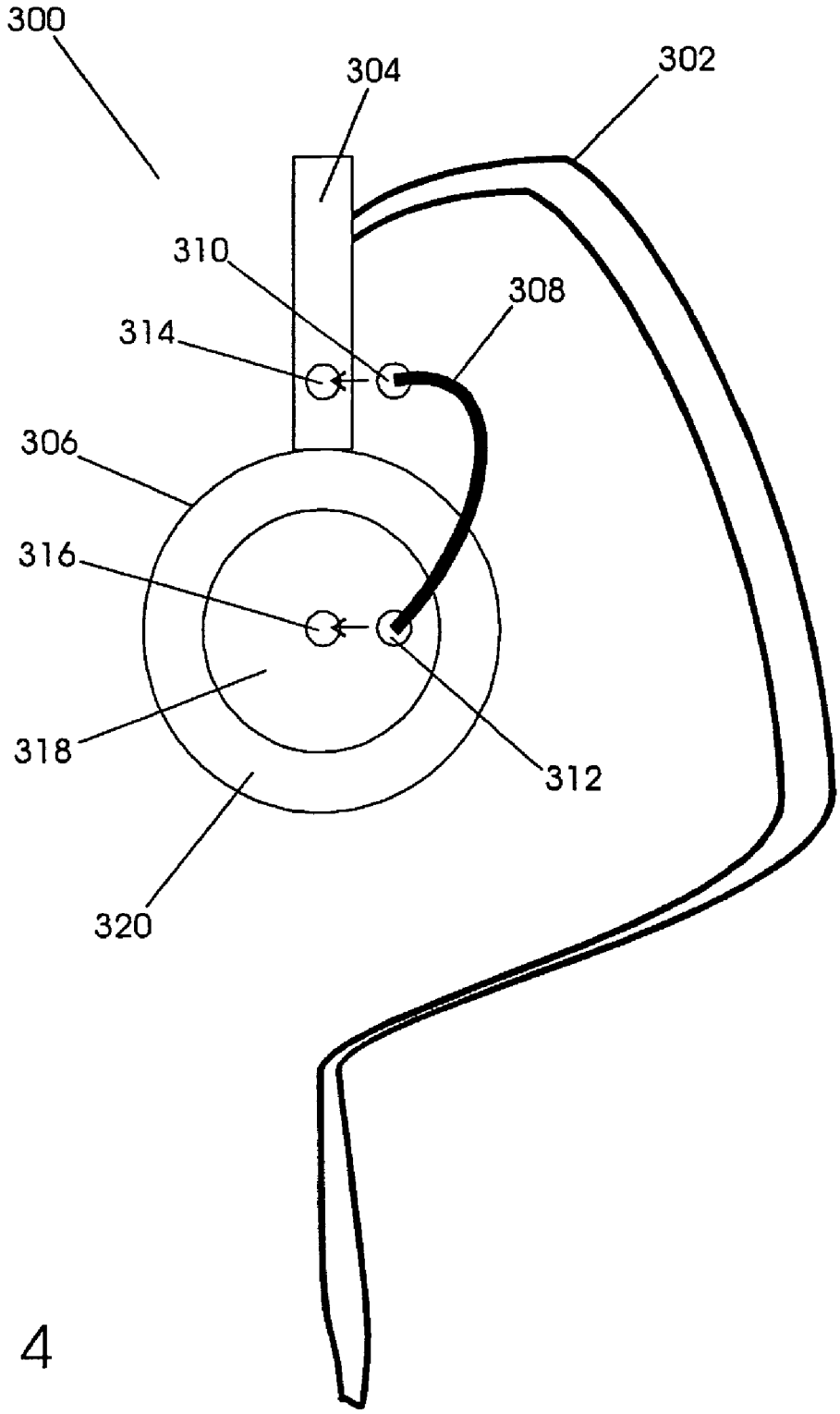
FIG. 4 is a front view of the embodiment of FIG. 3.

FIGS. 3-4 show another embodiment of an adjustable earphone according to the invention. Sound direction/stereo effect 3D adjustable earphone 300 includes an adjustable ear clip unit 302 adapted to be supported by a user's ear for holding the earphone on a user's ear. The size, design, shape, method of operation, and material of adjustable ear clip unit 302 may vary.

Earphone 300 also includes an adjustable holder unit 304 connected to clip unit 302, which includes a holder socket 314. An ear cup unit 306 is connected to holder unit 304, which includes an adjustable filter unit 320 for blocking and directing sound.

Earphone 300 also includes an adjustable center speaker unit 318 and an adjustable unit 308. Speaker unit 318 is disposed in ear cup unit 306, and includes a speaker socket 316. Adjustable unit 308 includes a flexible band having a first end and a second end, a first ball 310 disposed at the first end and received within holder socket 314, and a second ball 312 disposed at the second end and received within speaker socket 316.

Again, it should be understood that balls 310, 312 may be replaced with sockets and sockets 314, 316 may be replaced with balls. Thus, the position and function of the balls and sockets can be switched with each other if necessary.

Figure 5:
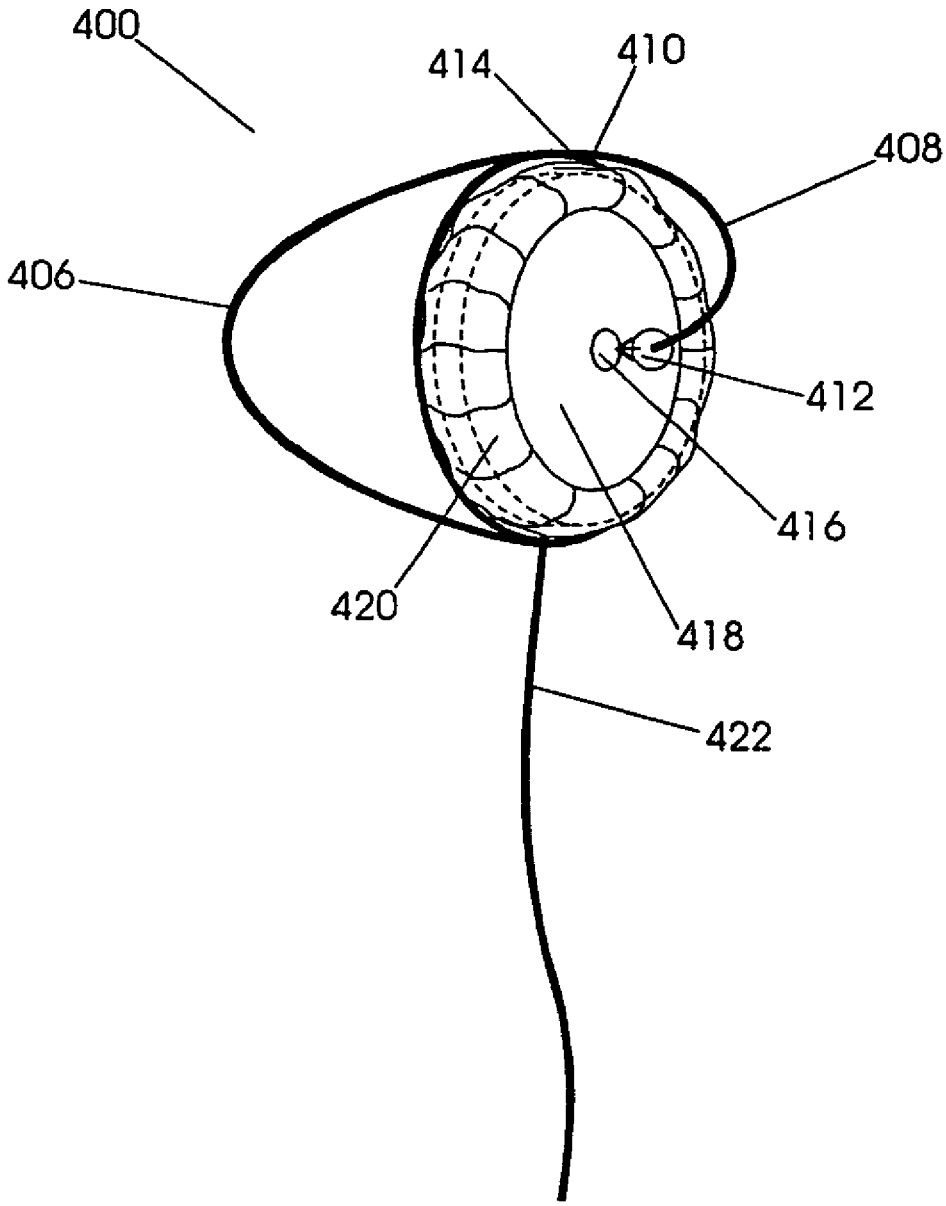
FIG. 5 is a perspective view of a third embodiment of one earphone in accordance with the invention.
Figure 6:
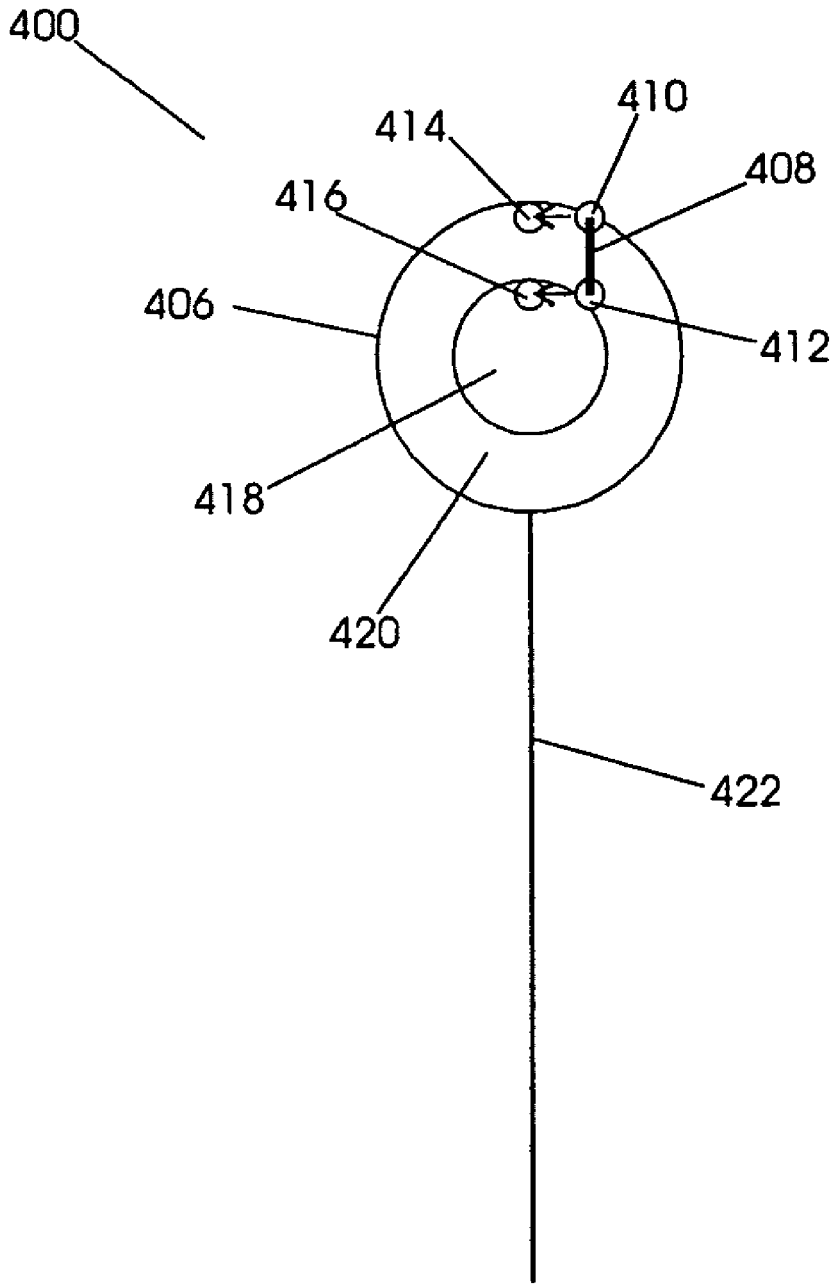
FIG. 6 is a front view of the embodiment of FIG. 5.

FIGS. 5-6 show another embodiment of an adjustable earphone according to the invention. Sound direction/stereo effect 3D adjustable earphone 400 includes an ear plug unit 406 that is dimensioned to fit snugly and comfortably in a user's ear outer and middle tunnel. Ear plug unit 406 includes an adjustable noise-concealing filter unit 420 that fits in the user's ear outer and middle tunnel and blocks and directs sound.

An adjustable center speaker unit 418 is disposed in ear plug unit 406, which includes a speaker receptacle 416. Earphone 400 also includes an adjustable unit 408 including a flexible band. A connector 412 is disposed at one end of flexible band and 408 is received within speaker receptacle 416. Another connector 410 is disposed at the other end of flexible band 408 and is received within a filter receptacle 414 in ear plug unit 406. A wire line 422 connects earplug unit 406 to a sound source, such as an audio signal manager, for transmitting the signal to speaker 418.

As with the previous embodiments, connectors 410, 412 may be designed so to receive connectors on the speaker and filter, such as balls in place of receptacles 414, 416.

Figure 7:
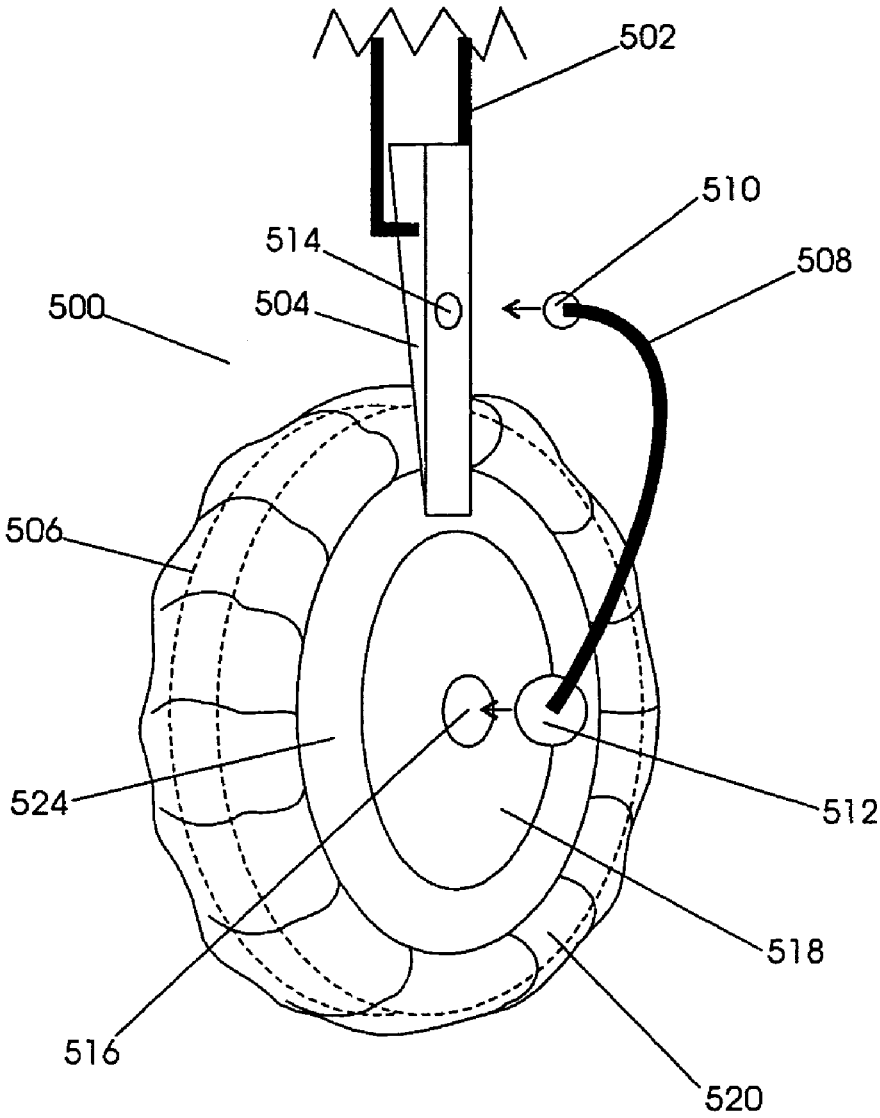
FIG. 7 s a perspective view of a fourth embodiment of one earphone in accordance with the invention.

FIG. 7 shows another embodiment of an adjustable earphone according to the invention. Sound direction/stereo effect earphone 500 includes an adjustable earphone clip unit 502, an adjustable earphone headband holder 504 connected to earphone clip unit 502, and an ear cup unit 506 connected to holder unit 504. Ear cup 506 includes a shell 524 to hold directly adjustable earphone headband holder 504 and a 3D adjustable center speaker unit 518. The size, design, shape, method of construction, and material of shell 524 may vary.

A loose or stretchable layer (not shown) may be added or installed between the outer edge of enter speaker 518 and the inside edge of shell 524 to provide more room for adjustment and to function as a sound filter.

Earphone 500 includes an adjustable unit 508 including a flexible band having a first end and a second end, a first ball 510 disposed at the first end and received within a holder socket 514 in holder unit 504 and a second ball 512 disposed at the second end and received within a speaker socket 516 in ear cup unit 506.

Ear cup unit 506 includes an adjustable filter unit 520 for blocking and directing sound.

As with the previous embodiments, balls 510, 512 may be replaced with female connectors such as sockets and sockets 514, 516 may be replaced with male connectors such as balls. Thus, the position and function of the balls and sockets can be switched with each other if necessary.

Figure 8:
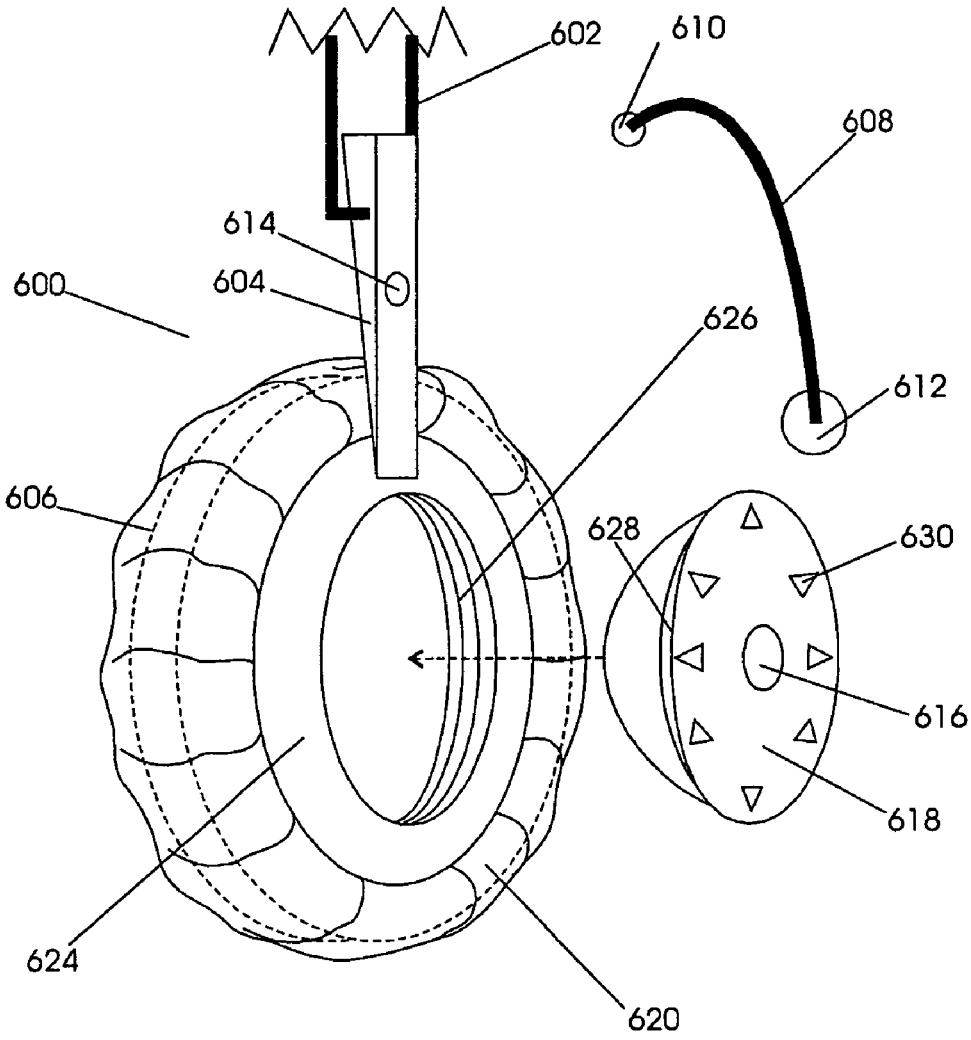
FIG. 8 is a perspective view of a fifth embodiment of one earphone in accordance with the invention.

FIG. 8 shows another embodiment of an adjustable earphone according to the invention. Sound direction/stereo effect 3D adjustable earphone 600 includes an adjustable earphone clip unit 602, an adjustable holder unit 604, an ear cup unit 606, and an adjustable center speaker unit 618. Holder unit 604 is connected to clip unit 602 and contains a holder socket 614. Ear cup unit 606 is connected to holder unit 604 and includes an adjustable filter unit 620 for blocking and directing sound and a shell 624 to hold directly adjustable earphone headband holder 604 and 3D adjustable center speaker 618.

Inside the hole formed by shell 624 is an adjustable and movable clip female indentation or mark 626. A male clip mark 628 is on the edge of adjustable and movable center speaker 618. In order to adjust in the earphone stereo sound direction in three (3D) dimensions in a user's ear without moving the whole earphone or ear cup, a user can push in or pull out at any top edge side or center speaker 618, preferably following the edge push signs 630 on the top side of center speaker 618. Male and female clip marks 626, 628 are matchable and movable and adjustable in three dimensions in order to achieve the adjustment of adjustable center speaker 618 along the X-Y-Z axes, i.e. three dimensionally, at any time and for any situation for a user's better comfort and to provide real time 3D stereo sound effects. The size, design, shape, method of construction, and material of shell 624 and of clip marks 626,628 may vary.

Adjustable earphone 600 may also include, if needed, an adjustable unit 608 including a flexible band having a first end and a second end, a first ball 610 disposed at the first end and received within a holder socket or hole 614, and a second ball 612 disposed at the second end and received within a speaker socket of hole 616.

As with the previous embodiments, balls 610, 612 may be replaced with female connectors such as sockets and sockets 614, 616 may be replaced with male connectors such as balls. Thus, the position and function of the balls and sockets can be switched with each other if necessary.

Figure 9:
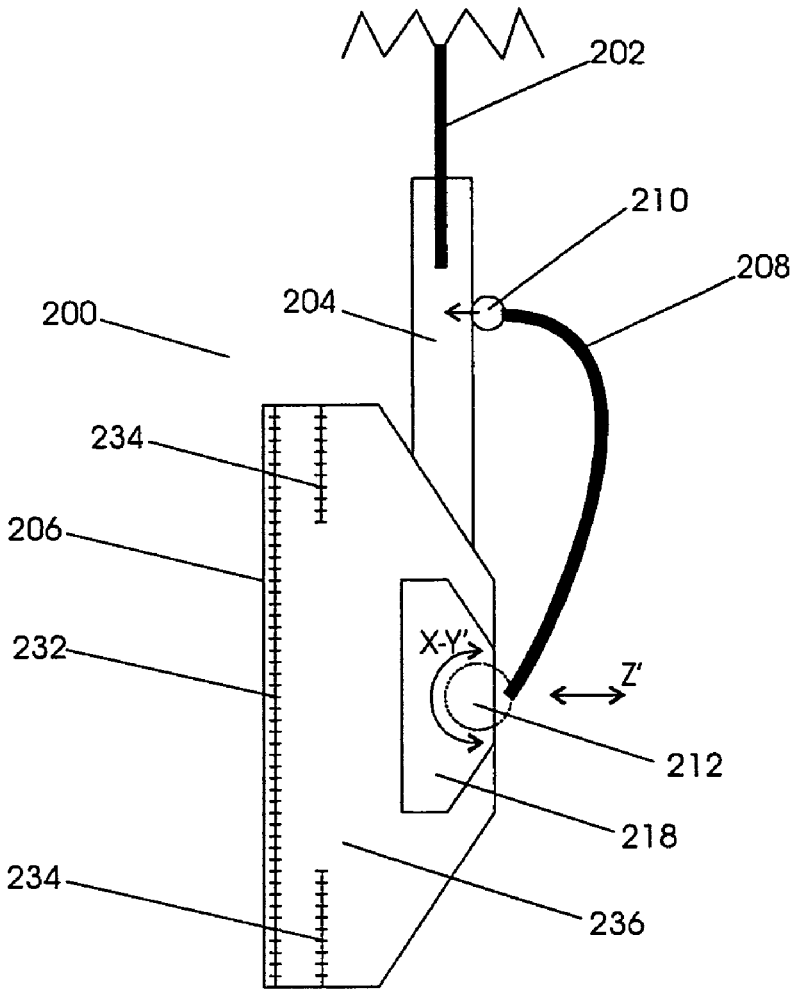
FIG. 9 is a cross-sectional view of a variant of the embodiment of FIG. 1.

FIG. 9 shows a variant of the first embodiment of the adjustable earphone shown in FIGS. 1-2. Earphone 200 includes an adjustable earphone clip unit 202, an adjustable holder unit 204 connected to clip unit 202 including a holder socket, an ear cup unit 206 connected to holder unit 204, and an adjustable center speaker unit 218 disposed in ear cup unit 206 including a speaker socket as in the embodiment of FIGS. 1-2. Inside cup unit 206 are a large sound check member or piece 232 and two smaller sound check members or pieces 234. The sound check members create sound flows, thereby creating a sound resonant area 236 within ear cup unit 206. When speaker 218 is adjusted in three (3D) directions as indicated in FIG. 9 as X-Y-Z, the sound delivered from adjustable speaker 218 generates a changeable resonance or resound among the sound pieces 232, 234, 234 and a resonant area 236 into a user's ear tunnel for comfortable sound listening.

The location, size, shape, design and material of the large/small sound check pieces 232/234 and the resonant area 236 may vary. This direction adjustable resonant sound arrangement can also be used in all the other embodiments of the adjustable earphone according to the invention, including the embodiments shown in FIGS. 1 to 8 and 10-11.

As in the embodiment of FIGS. 1-2, earphone 200 includes an adjustable unit 208. Adjustable unit 208 includes a flexible band having a first end and a second end, a first ball 210 disposed at the first end and received within a holder socket, and a second ball 212 disposed at the second end and received within a speaker socket.

As with the previous embodiments, balls 210, 212 may be replaced with female connectors such as sockets, and the holder and speaker sockets may be replaced with male connectors such as balls. Thus, the position and function of the balls and sockets can be switched with each other if necessary.

Figure 10:
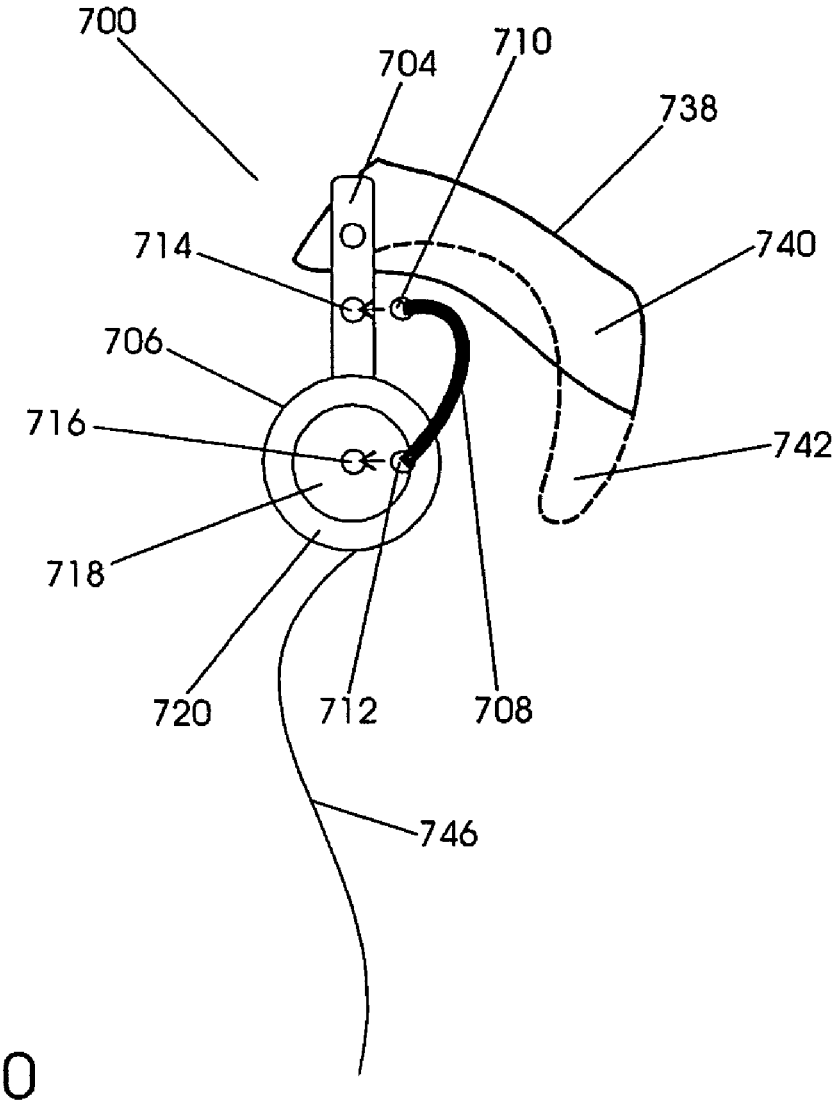
FIG. 10 is a front view of a sixth embodiment of one earphone showing an ear band holding arrangement in accordance with the invention.

FIG. 10 shows another embodiment of an adjustable earphone according to the invention. Sound direction and stereo effect 3D adjustable earphone 700 includes an adjustable center speaker unit 718 with speaker socket 716 disposed in an ear cup unit 706 and uses an advantageous form of an ear band unit 738 adapted to be supported by a user's ear.

As with the previous embodiments, balls 210, 212 may be replaced with female connectors such as sockets and the holder and speaker sockets replaced with male connectors such as balls. Thus, the position and function of the balls and sockets can be switched with each other, if necessary.

Ear band unit 738 holds the entire adjustable earphone 700 on a user's ear and contains an ear front top piece 740 and an ear back piece 742 indicated by the dashed or stitch line. Ear front top piece 740 is adapted to follow the top shape or upper portion of a user's ear, leaving enough space to allow the adjustment of center speaker 718. Ear back piece 742 is adapted to follow the back shape or rear portion of a user's ear and to hold on or be supported along the back side or rear portion of a user's ear. Two narrow pieces (not shown) may be added on between ear front top piece 740 and ear back piece 742 (one piece for each end). In this way, a user can comfortably put the ear band earphone 700 on the top of his or her ear and then easily adjust the independently hanging earphone speaker 718 into or around his or her ear tunnel for more comfortable wearing and listening.

The size, location, design, shape, method of construction, and material of the adjustable ear band unit 738 may vary.

The 3D sound adjustable center speaker 718 may be directly connected to ear band unit 738 through an adjustable band/ball unit 708. The position and function of ball 710 and socket 714 of adjustable unit 708 may be switchable as in the previous embodiments. With this arrangement, a user may freely adjust the independently hanging center speaker 718 into his or her ear tunnel or move out and adjust the speaker around the outside of his or her ear tunnel for comfortable listening.

A wire line 746 may connect earphone 700 to any suitable audio/visual player. Wire line 746 may also be replaced via a wireless unit (not shown).

An adjustable wireless or cabled microphone unit or multiple media player unit (not shown) may be attached to 3D sound direction and stereo adjustable earphone 700.

The 3D sound direction and stereo effect adjustable earphone 700 may contain the functions and parts of the earphone embodiments shown in FIGS. 1-9 which have been discussed previously, including adjustable holder unit 704 with holder socket 714, adjustable unit 708 with first and second balls 710, 712 at respective ends of a flexible band, and adjustable filter unit 720 for blocking and directing sound.

Figure 11:
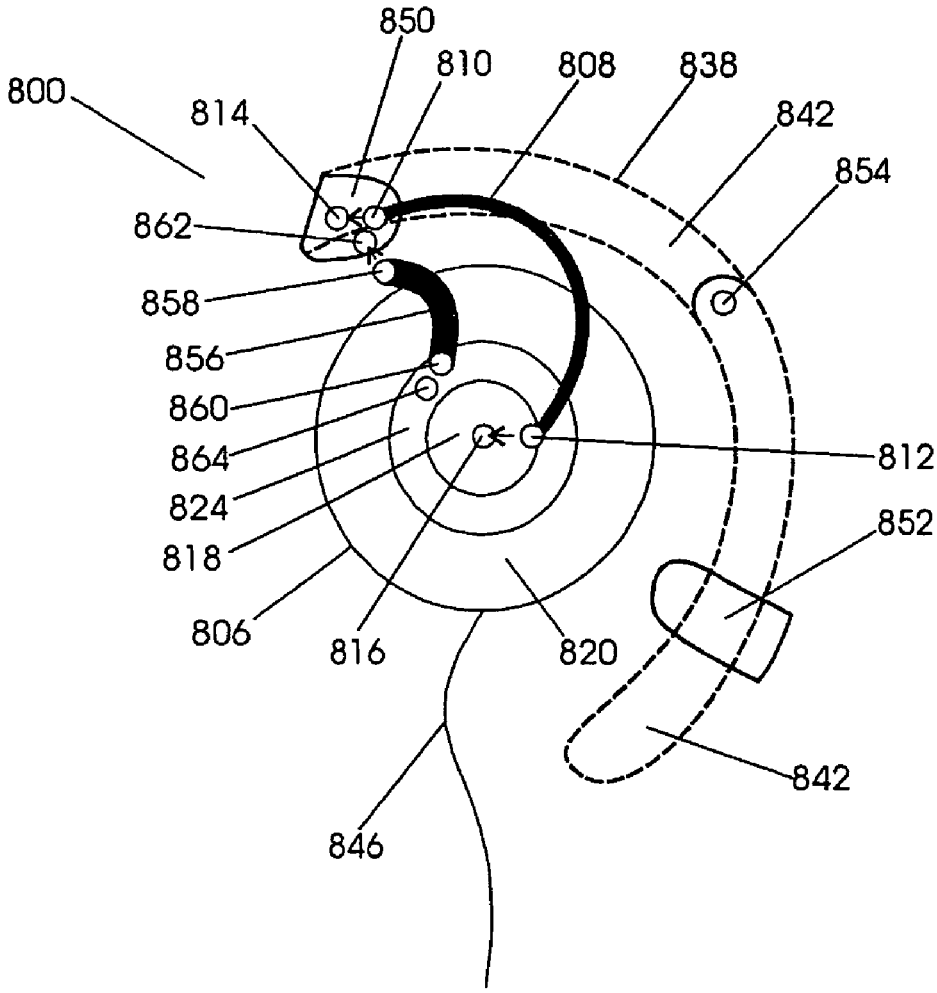
FIG. 11 is a front view of a seventh embodiment of one earphone showing an ear band holding arrangement in accordance with the invention.

FIG. 11 shows another embodiment of an adjustable earphone according to the invention. Sound direction and stereo effect 3D adjustable earphone 800 includes an adjustable ear speaker unit 818 with a speaker socket 816 disposed in an ear cup unit 806 and uses another advantageous form of an ear band unit 838.

Ear band unit 838 holds the entire adjustable earphone 800 on a user's ear and contains an ear front top piece 850, an ear front bottom piece 852, and an ear back piece 842 indicated by the dashed or stitch line. Ear front top piece 850 is adapted to follow the top point shape of a user's ear and to leave enough space to manipulate adjustable earphone cup unit 806. Ear back piece 842 is adapted to follow the back shape of a user's ear and to hold on along the back side of a user's ear. Two narrow pieces (not shown) may be added on between ear front top piece 850, ear front bottom piece 852 and ear back piece 842 (one piece for each end). Ear front bottom piece 852 holds or clips ear band holder unit 838 to the bottom of a user's ear from back to front firmly. An adjustable joint part 854 may be added onto ear back band 842. In this way, a user can comfortably put ear band earphone 800 on the top of his or her ear and then easily adjust the independently hanging earphone cup unit 806 around his or her ear for more comfortable wearing and listening because this structure and function can avoid any kind of uncomfortable ear phone-ear holding contact pressure on part or all of a user's ear or inside a user's ear tunnel.

The size, location, design, shape, method of construction and material of adjustable ear holding band unit 838 may vary.

An adjustable holder 856 connects an ear cup unit 806 for three dimensional adjustment to the front top end 850 of earphone 800. Adjustable unit 856 contains a small ball 858 at one end to fit into a hole or socket 862 at front top piece 850 and another small ball 860 to fit into another hole or socket 864 at the shell 824 of adjustable ear cup unit 806. The position and function of the balls and sockets can be switched with each other, if necessary. In this way, ear cup unit 806 can be freely pulled out or pushed in and turned around for adjustment along X-Y-Z axes, i.e. three (3D) dimensionally.

Ear cup unit 806 also contains an adjustable ear speaker unit 818 at the center of earphone 800 to deliver sounds to a user's ear hearing system. A three dimensionally adjustable direction unit 808 cooperates with adjustable ear speaker unit 818. Adjustable unit 808 contains a small ball 810 at one end to fit in a hole or socket 814 at front top piece 850 and another small ball 812 to fit into another hole or socket 816 at adjustable ear speaker unit 818. The position and function of the balls and sockets can be switched with each other, if necessary. In this way, ear center speaker unit 818 can be freely pulled out or pushed in and turned around for adjustment in X-Y-Z directions, i.e. three (3D) dimensionally, to achieve adjustable stereo sound direction and effect to deliver stereo sound comfortably into a user's ear without moving the entire earphone 800 or ear cup unit 806.

The size, location, design, method of construction, and material of the 3D direction adjustable unit 808 may vary.

Ear cup unit 806 also contains a sound conceal and sound direction adjustable filter unit 820 for blocking and directing sound.

The 3D sound adjustable center speaker 818 may be directly connected onto ear front top unit 850/838 through an adjustable band/ball unit 808. The position and function of ball 810 and socket 814 of adjustable unit 808 may be switched. In this way, a user can freely adjust the independently hanging center speaker 818 into his or her ear tunnel or move out and adjust around the outside of his or her ear tunnel for the user's comfortable listening to avoid any kind of uncomfortable earphone-ear holding contact pressure on part or all of a user's ear or inside a user's ear tunnel.

Earphone cup unit 806 and center speaker unit 818 can be replaced with any kind of earphone speaker system, ear snug phone system, cell phone system, or micro multiple player system.

A wire line 846 may connect earphone 800 to any kind of audio/video player. Wire line 846 may be replaced with any kind of wireless unit (not shown).

An adjustable wireless or cabled microphone unit, or a wireless or cabled multiple media player (not shown) may be attached onto 3D sound direction and stereo adjustable earphone 800.

The 3D sound direction and stereo effect adjustable earphone 800 may separate adjustable ear holding band unit 838, direction 3D adjustable unit 808, and ear cup unit 806 and speaker unit 818. In other words, these four units 838, 808, 806, 818 may operate independently of each other and/or form an assembly together wholly or partially through the joining of ball 810, socket 814, ball 812, socket 816, ball 858, socket 862, ball 860, socket 864 or similar units. Ear cup unit 806 and speaker unit 818 may be replaced with any known earphone (not shown). Therefore, earphone 800 may be structured to combine independent adjustable ear holding unit 838 and 3D direction adjustable unit 808 with any kind of independent earphone (not shown) together. Ear cup unit 806 and speaker unit 818 may be independently suspended, attachable, and detachable from ear holding unit 848 and adjustable unit 808.

Adjustable sound direction and stereo effect earphone 800 may contain all functions and parts shown in FIGS. 1-10 and the details as explained previously with respect to those embodiments.

As with the previous embodiments, each socket 814, 816, 862, 864 may be replaced with a male connector such as a ball and each ball 810, 812, 858, 860 may be replaced with a female connector such as a socket.

Figure 12:
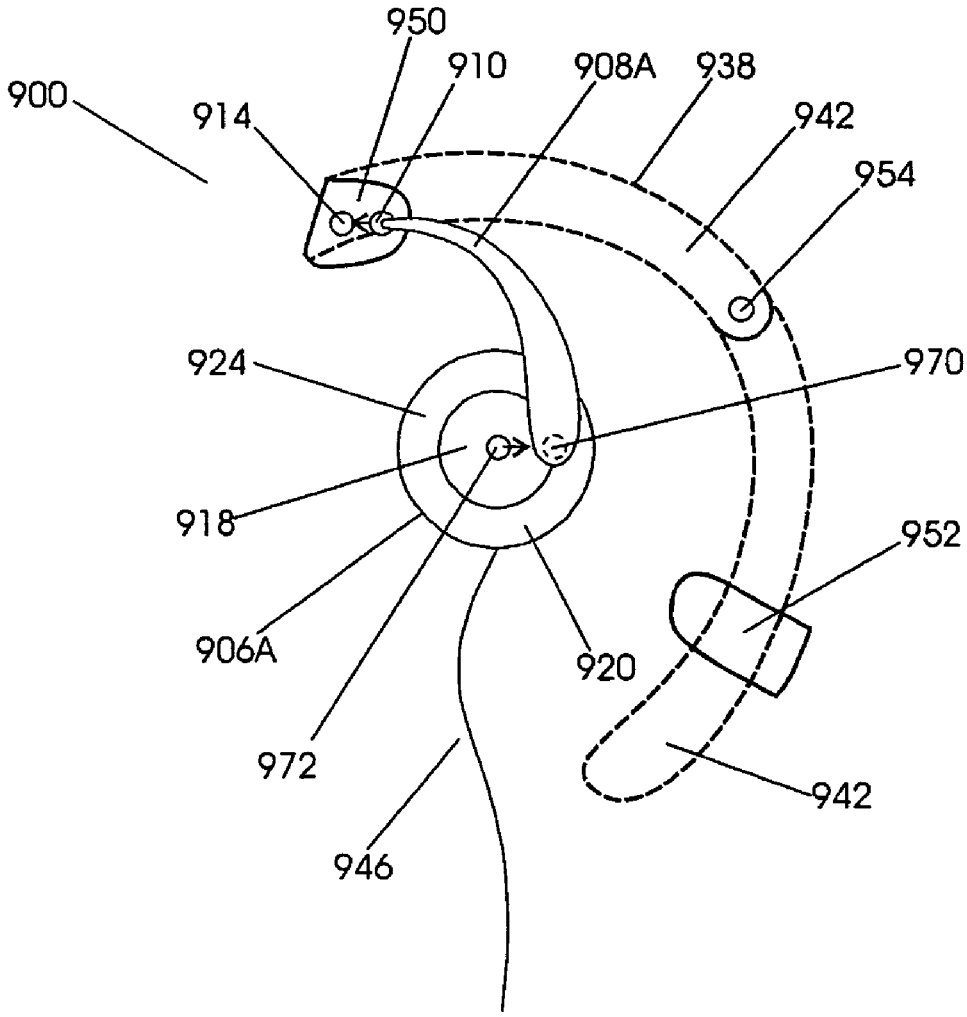
FIG. 12 is a front view of an eighth embodiment of one earphone where the adjustable unit contains a socket in accordance with the invention.

FIG. 12 shows one arrangement of an adjustable earphone 900 where the adjustable unit 908A contains a socket 970 at one end. In this embodiment, the center speaker 918 contains the ball 972 to work with the socket 970 for three dimensional (3D) free movements of the center speaker 918 and the earphone cup or snug 906A.

A ball 910 is at the other end of adjustable unit 908A which is adapted to fit in a hole or socket 914 of an ear front top piece 950. Ear front top piece 950 is part of an ear band unit 938 which holds the entire adjustable earphone 900 on a user's ear. Ear band unit 938 also contains an ear front bottom piece 952 and an ear back piece 942. An adjustable joint part 954 may be added onto ear back band 942.

Earphone cup unit 906A contains a sound conceal and sound direction adjustable filter unit 920 for blocking and directing sound, and a shell 924. A wire line 946 may connect earphone 900 to any kind of audio/video player and may be replaced with any kind or wireless unit.

Figure 13:
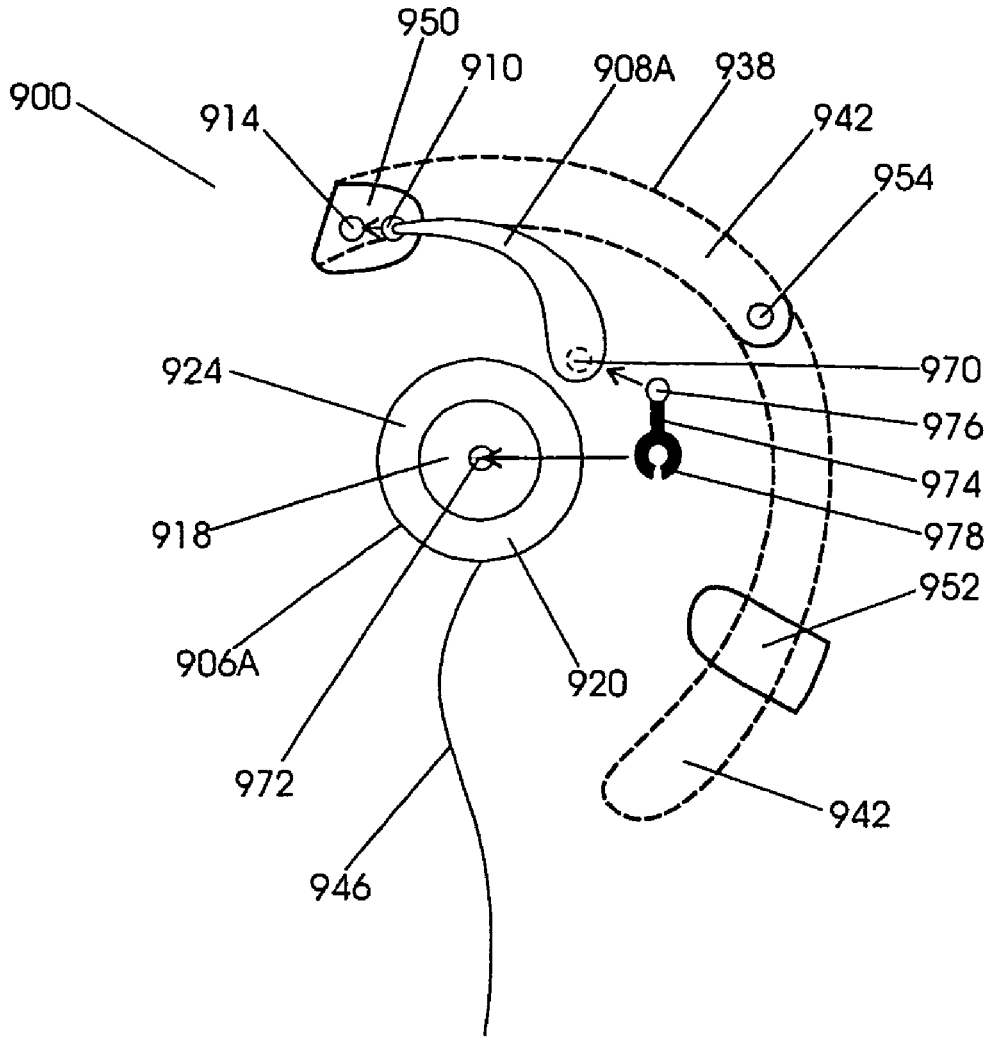
FIG. 13 is a front view of a variant of the embodiment of FIG. 12.

FIG. 13 shows another arrangement of an adjustable earphone 900 where the ear holding unit 938, the three dimensional (3D) adjustable unit 908A, and an independent earphone cup or snug unit 906A may be separated from each other and reassembled in whole or in part by using a ball-clip unit 974 and the other joint units 910, 914, 970, 972 or similar units. In other words, an adjustable earphone 900 can be structured to combine or assemble independent adjustable ear holding unit 938 and three dimensional (3D) direction adjustable unit 908A with any kind of independent earphone 906A together through use of a ball clip or joint unit 974 and the other joint units 910, 914, 970, 972 or similar units.

Ball-clip unit 974 has a ball 976 to work with a socket 970 of adjustable unit 908A. At the other end, ball-clip unit 974 has a clip unit 978 to clip, hold, fasten or attach any type of independent earphone system in suspension and freely for three dimensional (3D) adjustable earphone functions around or into a user's ear tunnel.

Ball-clip unit 974 may be combined directly into the bottom part of adjustable unit 908A. Alternatively, the position and function of socket 970 of adjustable unit 908A may be replaced with ball-clip unit 974 directly for combination of adjustable unit 908A and ball-clip unit 974 into one piece.

Ball-clip unit 974 and the other joint units 910, 914, 970, 972 or similar units may vary in size, location, design, shape, style, material and method of operation.

An ear cup unit 906A includes an adjustable filter unit 920 for blocking and directing sound and a shell 924 to hold a 3D adjustable center speaker unit 918. A wire line 946 may connect earphone 900 to any suitable audio/visual player and may be replaced by a wireless unit.

Ear hold unit 938 holds the entire adjustable earphone 900 on a user's ear and contains an ear front top piece 950, an ear front bottom piece 952, and an ear back piece 942. An adjustable joint part 954 may be added onto ear back band 942.

FIGS. 14-15 show further details of the sound stereo wave/level frequency controller unit 280. There is an LCD or LED display screen 282 to show the earphone direction indicator 284 in three dimensional directions: vertical (North or South), horizontal (East or West), and deep (Z axis direction). For example, at the beginning when a user sits on a chair facing North, the earphone direction indicator 284 shows "N0W0Z0". Then the user moves his or her face toward North and West. At that time, the earphone direction indicator 284 shows "N2W1Z0". When the indicator 284 shows "N0W0Z0", the sound stereo controller unit 280 will not add, reduce, or change in any channel, level or band 290 of the original sound play output. See FIG. 15. When the indicator 284 shows "N2W1Z0", the sound stereo controller unit 280 will follow the mode selected by the user to add, reduce or balance all channels or levels 290 of the original stereo sound play output.

As further explained with reference to FIG. 15, the channel 1 has an original sound stereo output level 292A, the channel 2 has an original sound stereo output level 292B, and the channel 3 has an original sound stereo output level 292C. Usually channel 1 is set up in the North/South direction, channel 2 set up in the Z axis or deep direction, and channel 3 set up in the East/West direction. When the indicator 284 shows "N2W1Z0", the channel 1 as vertical effect (North or South—Y axis) has two steps 294A to add on the original sound stereo play output, the channel 2 as deep point (standing point—Z axis) has zero steps to add on the original sound stereo play output, and the channel 3 as horizontal effect (East or West—X axis) has one step 294C to add on the original sound stereo play output. Therefore, at that time, the user can feel the sound stereo play output North side strongest, West side a little stronger, a Z dimension no change, just as in a real situation and with sound direction stereo change effects.

Of course, the channels or levels 1, 2, 3 of band 290 may be used, replaced, combined, or improved in whole or in part with any kind of function, system and method of any 3D sound stereo/wave/level/frequency controller, 3D sound stereo wave/level/frequency amplifier, or 3D sound stereo wave/level frequency equalizer.

The channels or levels 1, 2, 3 of band 290, the display 282, and indicator 284 may vary in size, design, location, shape, style, material or method and system of operation with more channels or levels.

The channels or levels 1, 2, 3 of band 290, the display 282, and indicator 284 may be visible or not depending on the user's needs. The display 282 may have multiple display functions, such as 3D or 2D direction indication, sound stereo output screen, radio screen, or multimedia player screen, etc. A user can select those functions through a mode selection.

The computerized sound wave/level/frequency controller unit 280 can be used or applied on any kind of digitalized audio or audio/video device or system in a 3D method or even in a 2D method. For example, the controller 280 can be used in a wireless or cabled earphone, a regular or traditional earphone system, a regular headset/headphone system, an audio device, an audio/video system, a telephone system, a PC system, a notebook computer, an Internet communication system, a cellular/satellite communication system, a home theater system, a car/ship/airplane audio/video system, a game system, in hearing assistance equipment or other suitable system.

Although several embodiments of the present invention have been shown and described, it is to be understood that many changes and modifications may be made thereunto without departing from the spirit and scope of the invention as defined in the appended claims.

What is claimed is:

1. An adjustable earphone comprising:

(a) an adjustable earphone clip unit;

(b) an adjustable holder unit connected to said clip unit, said holder unit comprising a holder connecting member;

(c) an ear cup unit connected to said holder unit, said ear cup unit comprising an adjustable filter unit for blocking and directing sound;

(d) an adjustable center speaker unit disposed in said ear cup unit, said speaker unit comprising a speaker connecting member; and (e) an adjustable unit comprising a flexible band having a first end and a second end, a first adjustable unit connecting member disposed at said first end and connecting with said holder connecting member, and a second adjustable unit connecting member disposed at said second end and connecting with said speaker connecting member.

2. The adjustable earphone according to claim 1 wherein said holder connecting member comprises a holder socket, said speaker connecting member comprises a speaker socket, said first adjustable unit connecting member comprises a first ball received within said holder socket, and said second adjustable unit connecting member comprises a second ball received within said speaker socket.

3. The adjustable earphone according to claim 1 wherein said adjustable earphone clip unit is a headband clip unit adapted to be worn on a user's head.

4. The adjustable earphone according to claim 1 wherein said adjustable earphone clip unit is an ear clip unit adapted to be supported by a user's ear.

5. The adjustable earphone according to claim 1 wherein said ear cup unit further comprises a shell for mounting said adjustable holder unit and said adjustable center speaker unit.

6. The adjustable earphone according to claim 5 further comprising an adjustable and movable clip female mark disposed within a recess of said shell and a male clip mark disposed on an edge of said center speaker unit, said male and female marks cooperating to permit adjustment of said center speaker unit within said shell in any direction in three dimensional space.

7. The adjustable earphone according to claim 6 further comprising a plurality of indicia circumferentially disposed on a surface of said center speaker unit to facilitate adjustment of said center speaker unit within said shell by a user.

8. The adjustable earphone according to claim 1 further comprising a controller unit disposed in said adjustable center speaker unit, said controller unit detecting and analyzing a change in orientation of said adjustable center speaker unit and automatically adjusting sound or stereo output of said center speaker unit.

9. The adjustable earphone according to claim 8 wherein said controller unit is adapted to cooperate with a digitalized audio system or audio/video system.

10. An adjustable earphone comprising:

(a) an ear plug unit comprising an adjustable filter unit for blocking and directing sound, said ear plug unit being dimensioned to fit between outer and middle tunnels of a user's ear, said filter unit comprising a filter connector;

(b) an adjustable center speaker unit disposed in said ear plug unit, said speaker unit comprising a speaker connector;

(c) an adjustable unit comprising a flexible band having a first end, and a second end, a first adjustable unit connector disposed at said first end and connecting with said speaker connector, and a second adjustable unit connector disposed at said second end and connecting with said filter connector; and (d) a wire line connecting said ear plug unit to a sound source.

11. The adjustable earphone according to claim 10 wherein said alter connector comprises a filter receptacle, said speaker connector comprises a speaker receptacle, said first adjustable unit connector is received within said speaker receptacle, and said second adjustable unit connector is received within said filter receptacle.

12. An adjustable earphone comprising:

(a) an adjustable earphone clip unit;

(b) an adjustable holder unit connected to said clip unit, said holder unit comprising a holder socket;

(c) an ear cup unit connected to said holder unit, wherein said ear cup unit comprises first, second and third sound check members disposed within said ear cup unit, said first sound check member being larger than said second and third sound check members, said sound check members adapted to create sound flows for creating a sound resonant area wherein adjustment of said center speaker unit in any direction in three dimensional space generates a changeable resonance among the sound check members for the resonant area;

(d) an adjustable center speaker unit disposed in said ear cup unit, said speaker unit comprising a speaker connector; and (e) an adjustable unit comprising a flexible band having a first end and a second end, a first adjustable unit connector disposed at said first end and connecting with said holder connector and a second adjustable unit connector disposed at said second end and connecting with said speaker connector.

13. The adjustable earphone according to claim 12 wherein said holder connector comprises a holder socket, said speaker connector comprises a speaker socket, said first adjustable unit connector comprises a first ball received within said holder socket and said second adjustable unit connector comprises a second ball received within said speaker socket.

14. An adjustable earphone comprising:

(a) an adjustable holder unit comprising a holder connector;

(b) an ear cup unit connected to said holder unit, said ear cup unit comprising an adjustable filter unit for blocking and directing sound;

(c) an adjustable center speaker unit disposed in said ear cup unit, said speaker unit comprising a speaker connector;

(d) an adjustable unit comprising a flexible band having a first end and a second end, a first adjustable unit connector disposed at said first end and connecting with said holder connector and a second adjustable unit connector disposed at said second end and connecting with said speaker connector; and (e) an ear band unit adapted to be supported by a user's ear, said ear band unit comprising an ear front top piece and an ear back piece, said ear front top piece being adapted to follow an upper portion of a user's ear, said ear back piece being adapted to follow a rear portion of a user's ear and to be supported on the rear portion of the ear.

15. The adjustable earphone according to claim 14 wherein said holder connector comprises a holder socket, said speaker connector comprises a speaker socket, said first adjustable unit connector comprises a first ball received within said holder socket, and said second adjustable unit connector comprises a second ball received within said speaker socket.

16. An adjustable earphone comprising:

(a) an ear band unit comprising an ear front top piece, an ear front bottom piece, and an ear back piece, said ear front top piece comprising a first ear band connector and a second ear band connector;

(b) an ear cup unit comprising an adjustable filter unit for blocking and directing sound and a shell comprising a shell connector;

(c) an adjustable holder unit connected to said ear band unit and mounted by said shell of said ear cup unit, said adjustable holder unit comprising a first holder connector at a first holder end connecting with the second ear band connector, and a second holder connector at a second holder end connecting with the shell connector;

(d) an adjustable ear speaker unit mounted by said shell and disposed in said ear cup unit, said speaker unit comprising a speaker connector; and (e) an adjustable unit comprising a flexible band having a first end and a second end, a first adjustable unit connector disposed at said first end and connecting with said first ear band connector, and a second adjustable unit connector disposed at said second end and connecting with said speaker connector.

17. The adjustable earphone according to claim 16 wherein said first ear band connector comprises an ear band socket, said second ear band connector comprises an ear band receptacle, said shell connector comprises a shell receptacle, said first holder connector comprises a first spherical connector received within the ear band receptacle, and said second holder connector comprises a second spherical connector received within said shell receptacle.

18. The adjustable earphone according to claim 16 further comprising an adjustable joint disposed on said ear front bottom piece, said adjustable joint connecting said ear front bottom piece with said ear back piece to facilitate adjustment of said ear cup unit around a user's ear shape.

19. The adjustable earphone according to claim 16 wherein said second holder connector comprises a socket and said shell connector comprises a ball.

20. The adjustable earphone according to claim 16 wherein said ear band unit, said adjustable holder unit, and said ear cup unit are separable from each other.

* * * * *